United States Patent [19]

Tazaki

[11] 4,075,798

[45] Feb. 28, 1978

[54] WATER COOLING JACKET FOR FIRE

[76] Inventor: Michiji Tazaki, 3-3-46, Haraichi, Annaka, Gunma, Japan, 379-01

[21] Appl. No.: 684,832

[22] Filed: May 10, 1976

[51] Int. Cl.[2] ..... E04B 1/92

[52] U.S. Cl. ..... 52/168; 52/404; 109/29

[58] Field of Search ..... 52/168, 169.6, 404; 137/340; 220/13, 9 B; 109/1 S, 29, 33

[56] References Cited

U.S. PATENT DOCUMENTS

| | | | |
|---|---|---|---|
| 2,558,694 | 6/1951 | Speig | 220/13 X |
| 3,779,179 | 12/1973 | Marois | 109/29 X |

*Primary Examiner*—Price C. Faw, Jr.
*Assistant Examiner*—Carl D. Friedman
*Attorney, Agent, or Firm*—Fleit & Jacobson

[57] ABSTRACT

This invention relates to a water cooling jacket for fire which aims at the protection of the human body from fire. More particularly, it relates to a water cooling jacket for fire comprising an inner case having a size capable of forming a given clearance inside an outer case which is open on the upper surface thereof, a double-door having a clearance at the inside thereof to the sides of said inner and outer cases so as to be able to open or close freely; a water supply pipe capable of supplying water to the clearance between said inner and outer cases and to the clearance of said double-door and an air supply tank filled with the air or oxygen inside the inner case together with a valve operated for water supply of said pipe inside the inner case.

8 Claims, 3 Drawing Figures

WATER COOLING JACKET FOR FIRE

BACKGROUND OF THE INVENTION

Recently, many large buildings have been stood built which, because of their great height and their being built close together make it difficult to escape from building at the outbreak of a fire. Many people have died a losing their homes, due to the state of confusion resulting from difficulty of escape due to the fire or the poisonous gas.

It is also difficult for the patient, child or the aged person to escape from their homes at time of fire.

This invention is a entirely novel technique which has been developed in view of these well known facts.

DETAILED DESCRIPTION OF THE DRAWING

Figure 1:
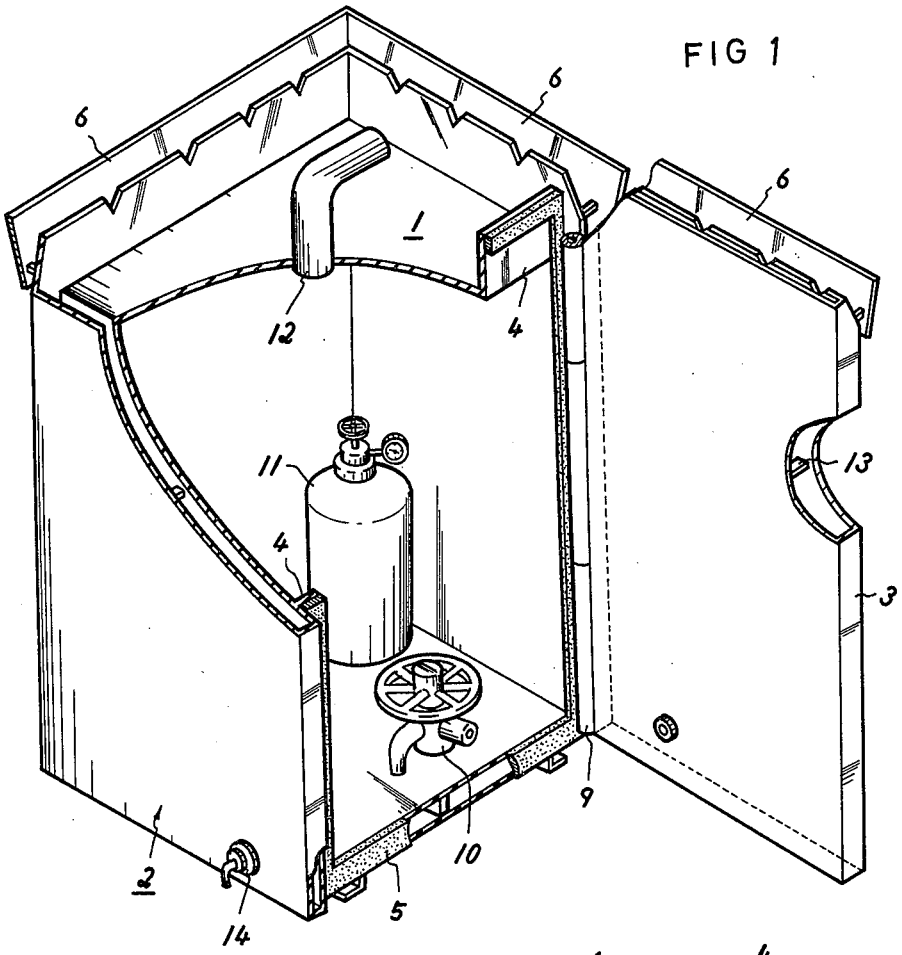
FIG. 1 is a perspective view of a jacket with a door according to the present invention.
Figure 2:
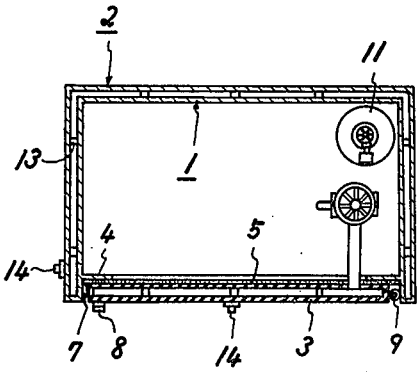
FIG. 2 is a transverse cross section of said jacket with shutting the door shut.
Figure 3:
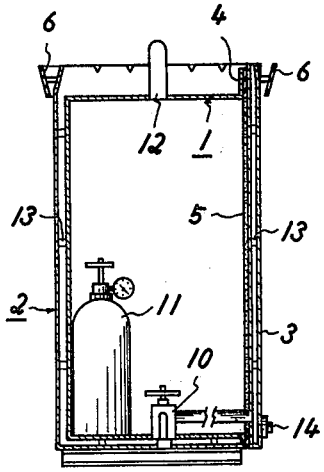
FIG. 3 is a vertical cross section of said jacket with the door shut thereof.

With reference to the description of the example according to this invention with the accompanying drawings, FIG. 1 to FIG. 3, 1 is an inner case open on one side thereof, and is of a size which is capable of forming a clearance between inner with an and outer case when the inner case is put into the outer case 2.

The numeral 2 is an outer case which open is on the upper surface and one side thereof respectively. The upper brim of the outer case is perforated with V shaped notches in spots and the upper brim inclines towards the insides of the case.

The numeral 3 is a door set up to open surfaces of the inner and outer cases, 1 and 2, through a hinge 9 so as to be able to open or close freely. The inside part of said door has a clearance open on the upper surface thereof and is consists of a double wall construction. The numeral 7 is a spring to stop said door 3, and 8 is a handle of said door.

The numeral 4 is a fitting plate of packing secured around the inner case 1, and a packing 5 is fixedly applied to one side of said plate. The door 3 is allowed to come closely into contact with said inner case 1 through said packing 5 so as to prevent the flow of the outer heated air and the poisonous gas into said inner case.

The numeral 6 is a guide plate mounted on the upper parts outside the outer case 2 and said door 3. Said guide plate is mounted so that the water may flow down along the outside of the outer case 2 without dispersing when a large amount of water overflows from said outer case 2 and said door 3.

The numeral 10 is a pipe for water supply which enters into said inner case 1 perforating the floor of inner and outer cases, 1 and 2 respectively, and its pointed end is branched into branch pipes capable of supplying the water to the clearance between said inner and outer cases, 1 and 2, and the clearance of said door 3 together with being capable of being opened and closed through the valve.

One of said branch pipes is led to the floor of said inner case 1 and another is led to the lower part of said door 3 through a flexible pipe made of rubber, plastic and the like respectively. The water is supplied to the clearance between the inner and outer doors, 1 and 2, and the clearance of said door 3 at the rate of 3 to 1.

The numeral 11 is a gas supplying tank filled with the compressed air or oxygen. The filling tank is set with a guage so that the amount of air or oxygen is directly proportional to the number of persons capable of being accomodated within said case.

The numeral 12 is an exhaust duct from which the air used in said case is discharged. The pointed end thereof may be put out towards the outdoor.

The numeral 13 is a rivet which connects the inner case 1 with the outer case 2 each other, and the numeral 14 is a drainpipe for cleaning.

In the example described above, it is necessary to make the upper parts of said outer case 2 protrude more than 10 cm. above the upper surface of the inner case 1 so that the water more than 10 cm. may gather at the upper surface of said inner case 1.

In order to circulate the water to the packing 5, it is effective to the heat to circulate the water accumulated on the upper surface of the inner case 1 by lowering the height of the packing 5 or the fitting plate 4 of the packing 5 than the height of the outer case 2. The plate made of metal, plastic and the like having more than 4 mm. in thickness can be used for said inner or outer case, 1 or 2.

Further, it is desirable to use such plates having more than 20 mm. in thickness for the clearances of the inner and the outer casses, 1 and 2, and of the door 3.

The jacket according to this invention has such a construction described above. Accordingly, at the fire, when said valve of the water supply pipe 10 is opened after entering the case and closing the door, the water is supplied from the lower part of said door 3 to the outer case 2 through the water supply pipe 10 and water is rapidly attained to the upper surface of the inner case 1. The water gathered on the surface of the inner case 1 overflows the V notch of the outer case 2. The said water then flows down along the total surfaces of said outer case 2 and of said outer surface of the door. At the same time, the supply of the air or the oxygen is also provided by opening the gas supply tank.

A double cooling system which circulates the water to the clearance between the inner and the outer cases and the clearance of the door, upper surface of said inner case, and an outside wall surface of said outer case respectively, is adopted to the jacket according with this invention. Accordingly, the heat of fire can be entirely isolated, and especially the water which flows down through the outside surface of said outer case has a feature which allows an increase of the cooling effect because said water is robbed of the evaporation heat occurred from the heat of the fire. Further more, the explosion caused by the water evaporation in said jacket can be entirely prevented because the upper part of the clearance between the outer case and the door is opened.

I claim:

1. A water cooling jacket for the protection of persons from fire comprising, an inner casing having enclosed top and bottom surfaces and side surfaces, one of said side surfaces being opened, an outer casing having an enclosed bottom surface, an open top surface, and side surfaces, one of said side surfaces being opened, the top, side, and bottom surfaces of said outer casing having dimensions greater than the top, side, and bottom surface dimensions of said inner casing, means for supporting said inner casing within said outer casing so that a space is formed between the bottom surfaces of said inner and outer casing, and between the side surfaces of said inner and outer casing, and wherein the open side surface of said inner casing is within the open surface of said outer casing, a door having an inner surface and an outer surface, and a space therebetween, means for hingedly mounting said door to enclose the open side surfaces of said inner and outer casings, means within said inner casing for supplying water to the space between the inner and outer casing and to the space between the inner and outer surfaces of said door, and to the outside of the top surface of said inner casing, means for supplying air or oxygen into the inner casing and water cooling means for providing water to the outside side surfaces of said outer casing for cooling the outside side surfaces of said outer casing.

2. A water cooling jacket as claimed in claim 1 further comprising packing means for providing packing between said door and the inner casing.

3. A water cooling jacket as claimed in claim 1 wherein said means for supplying air or oxygen comprise a supply tank within the inner casing.

4. A water cooling jacket as claimed in claim 1 wherein said means for supplying water comprises a water supply pipe extending through the bottom surface of the inner and outer casing into the inner casing, a valve means for controlling the flow of water mounted within the inner casing, and branch pipes for supplying water from the water supply pipe into the spaces between the inner and outer casing and the space between the inner and outer surfaces of said door.

5. A water cooling jacket as claimed in claim 1 further comprising an exhaust duct means for passing air from inside the inner casing to the exterior of the water cooling jacket.

6. A water cooling jacket as claimed in claim 1 wherein said water cooling means for providing water to the outside side surfaces of said outer casing comprises means for guiding water from the outside of the top surface of the inner casing along the outside side surfaces of said outer casing.

7. A water cooling jacket for the protection of persons from fire comprising, an inner casing having enclosed top and bottom surfaces and side surfaces, one of said side surfaces being opened, an outer casing having an enclosed bottom surface, an open top surface, and side surfaces, one of said side surfaces being opened, the top, side, and bottom surfaces of said outer casing having dimensions greater than the top, side, and bottom surface dimensions of said inner casing, means for supporting said inner casing within said outer casing so that a space is formed between the bottom surfaces of said inner and outer casing, and between the side surfaces of said inner and outer casing, and between the side surfaces of said inner and outer casing, and wherein the open side surface of said inner casing is within the open surface of said outer casing, a door having an inner surface and an outer surface, and a space therebetween, means for hingedly mounting said door to enclose the open side surfaces of said inner and outer casings, means within said inner casing for supplying water to the space between the inner and outer casing and to the space between the inner and outer surfaces of said door, and to the outside of the top surface of said inner casing, means for supplying air or oxygen into the inner casing and means for guiding the flow of water along the outside of the outer casing side surfaces, comprising a guide plate extending along the periphery of the side surfaces of said outer casing at the top end of said outer casing and the top end of said door, means for spacing said guide plate from the outer casing and the door and for inclining the guide plate with respect to the outer casing and the door, so that water that overflows the outer casing is guided by said plate to flow along the outside surface of said outer casing.

8. A water cooling jacket for the protection of persons from fire comprising, an inner casing having enclosed top and bottom surfaces and side surfaces, one of said side surfaces being opened, an outer casing having an enclosed bottom surface, an open top surface, and side surfaces, one of said side surfaces being opened, the top, side, and bottom surfaces of said outer casing having dimensions greater than the top, side, and bottom surface dimensions of said inner casing, means for supporting said inner casing within said outer casing so that a space is formed between the bottom surfaces of said inner and outer casing, and between the side surfaces of said inner and outer casing, and wherein the open side surface of said inner casing is within the open surface of said outer casing, a door having an inner surface and an outer surface, and a space therebetween, means for hingedly mounting said door to enclose the open side surfaces of said inner and outer casings, means within said inner casing for supplying water to the space between the inner and outer casing and to the space between the inner and outer surfaces of said door, and to the outside of the top surface of said inner casing, means for supplying air or oxygen into the inner casing and wherein the side surfaces of said outer casing at the open top surfaces are inclined inwardly, and include a plurality of notches spaced along the top portion of the side surfaces of the outer casing.

* * * * *